US008469186B2

(12) United States Patent
Pradeep

(10) Patent No.: US 8,469,186 B2
(45) Date of Patent: Jun. 25, 2013

(54) APPARATUS AND METHOD FOR DISPENSING AN ADDITIVE INTO A BEVERAGE

(76) Inventor: Anantha Pradeep, Piedmont, CA (US)

( * ) Notice: Subject to any disclaimer, the term of this patent is extended or adjusted under 35 U.S.C. 154(b) by 0 days.

(21) Appl. No.: 13/253,067

(22) Filed: Oct. 5, 2011

(65) Prior Publication Data

US 2013/0087472 A1 Apr. 11, 2013

(51) Int. Cl.

| | |
|---|---|
| ***B65D 25/08*** | (2006.01) |
| ***B65D 81/32*** | (2006.01) |
| ***B67D 1/00*** | (2006.01) |

(52) U.S. Cl.
USPC ..... 206/219; 222/83; 426/115

(58) Field of Classification Search
USPC ..... 206/219, 222; 426/112, 115, 120; 141/100–105; 222/80–83
See application file for complete search history.

(56) References Cited

U.S. PATENT DOCUMENTS

| | | | | |
|---|---|---|---|---|
| 3,743,520 | A * | 7/1973 | Croner | 206/219 |
| 4,264,007 | A * | 4/1981 | Hunt | 206/219 |
| 4,333,581 | A * | 6/1982 | Flansburg | 426/120 |
| 4,524,078 | A * | 6/1985 | Bardsley et al. | 426/112 |
| 5,290,574 | A * | 3/1994 | Jamieson et al. | 426/112 |
| 5,711,420 | A * | 1/1998 | Spring | 206/222 |
| 5,819,923 | A * | 10/1998 | Spring et al. | 206/222 |
| 5,885,635 | A * | 3/1999 | Spring et al. | 426/120 |
| 6,250,346 | B1 * | 6/2001 | Castillo | 206/219 |
| 6,263,923 | B1 * | 7/2001 | Castillo | 206/219 |
| 6,363,978 | B2 * | 4/2002 | Castillo | 206/219 |
| 7,798,056 | B2 * | 9/2010 | Kramer | 206/222 |
| 7,896,154 | B2 * | 3/2011 | Boatner | 206/221 |
| 7,967,135 | B2 * | 6/2011 | Boatner | 206/222 |

* cited by examiner

*Primary Examiner* — Bryon Gehman
(74) *Attorney, Agent, or Firm* — Kwan & Olynick LLP

(57) ABSTRACT

The present invention describes a beverage container that is configured to dispense an additive into a beverage. The beverage container includes a vessel configured to hold a beverage and a lid that includes a flap configured to expose the beverage in the vessel after the flap is triggered. This beverage container also includes a chamber configured to hold an additive that can be exposed to the beverage after the flap is triggered.

11 Claims, 6 Drawing Sheets

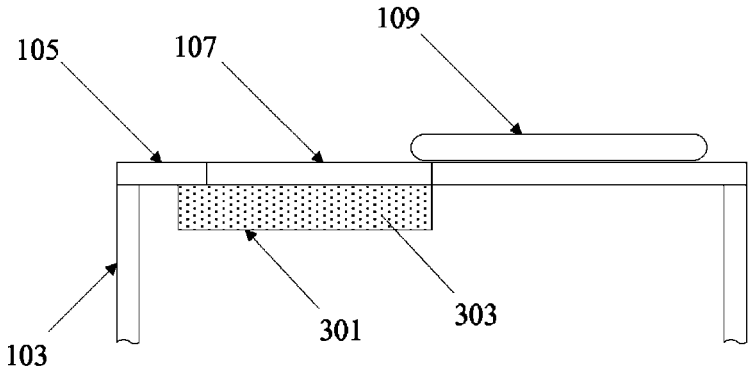
Figure 3A
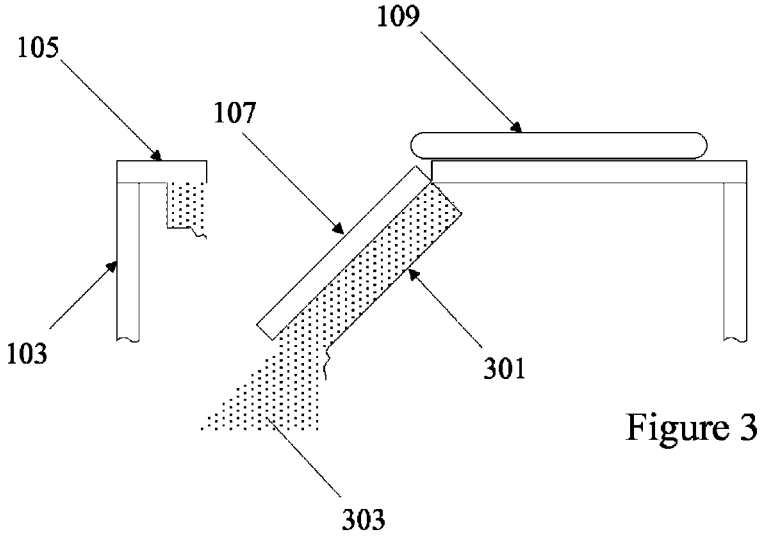
Figure 3B
Figure 3

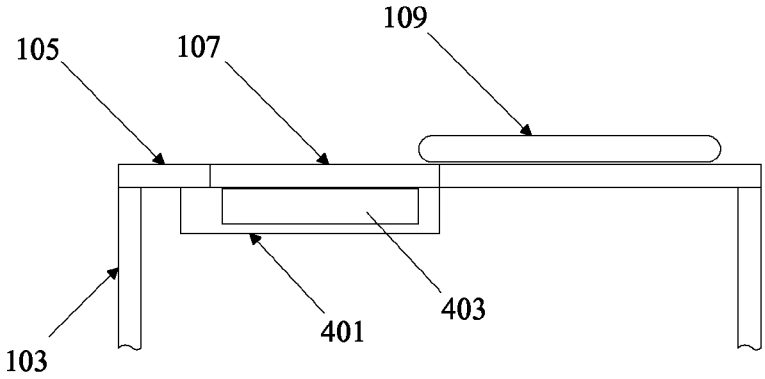
Figure 4A
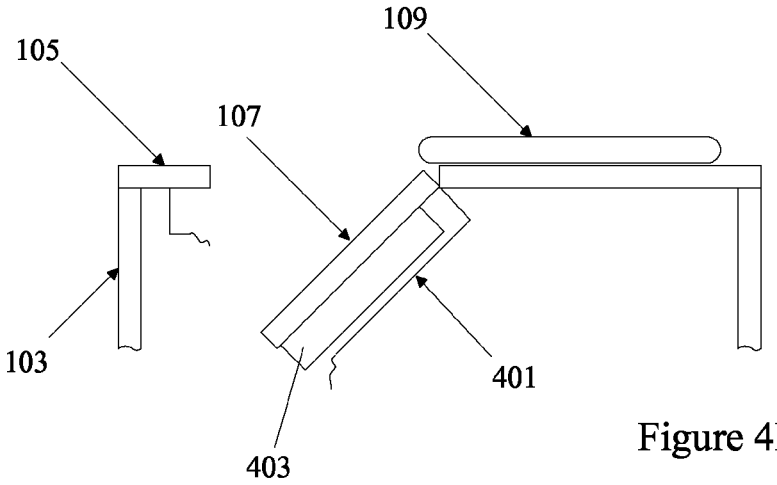
Figure 4B
Figure 4

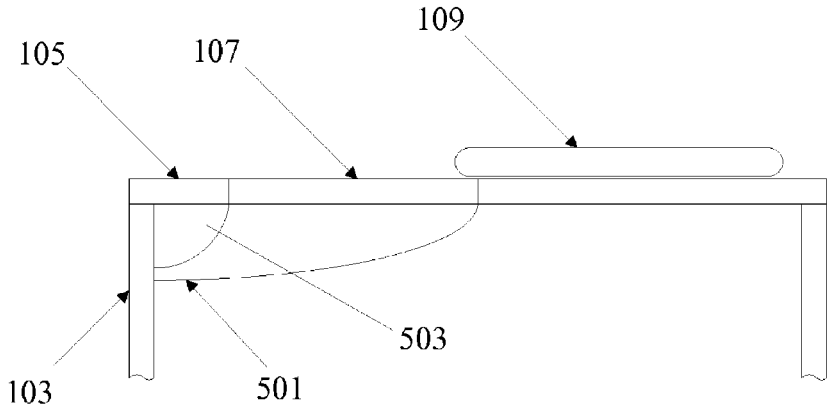
Figure 5A
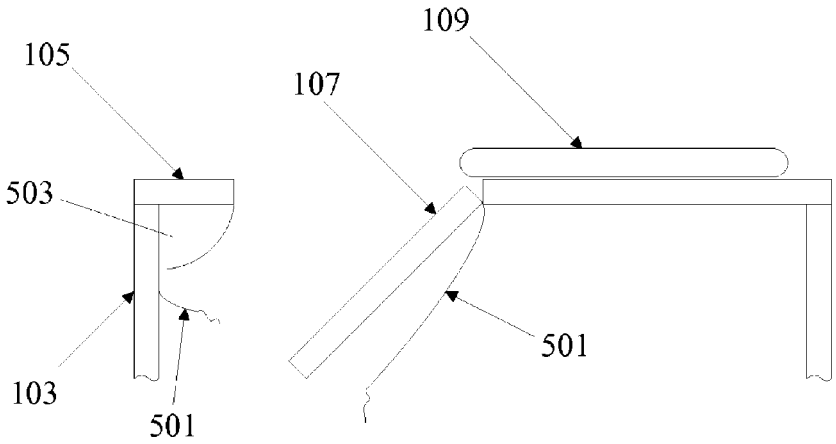
Figure 5B
Figure 5

APPARATUS AND METHOD FOR DISPENSING AN ADDITIVE INTO A BEVERAGE

TECHNICAL FIELD

The present disclosure relates to beverage containers and dispensing an additive into a beverage.

DESCRIPTION OF RELATED ART

Beverages, such as soft drinks, sodas, carbonated drinks, and the like are commonly provided in containers such as aluminum cans, which are easy to store and serve. These beverages can be consumed directly from a container or poured into a cup or glass. Although these beverages can be consumed without alteration, some people enjoy adding other ingredients to enhance or complement the beverage's flavor. Adding such an ingredient at the time of consumption may enhance the enjoyment of the beverage. However, manual methods of adding an ingredient to a beverage are inconvenient and time-consuming. Consequently, it is desirable to provide improved mechanisms for dispensing an ingredient into a beverage.

SUMMARY

The present invention describes a beverage container that is configured to dispense an additive into a beverage. The beverage container includes a vessel configured to hold a beverage and a lid that includes a flap configured to expose the beverage in the vessel after the flap is triggered. This beverage container also includes a chamber configured to hold an additive that can be exposed to the beverage after the flap is triggered.

According to various embodiments of the present invention, an additive can be dispensed into a beverage when a flap of a beverage container is triggered. Specifically, when the flap is triggered, an opening in the lid of the beverage container is created and a chamber holding the additive is punctured. Once the chamber is punctured, the additive is exposed to the beverage. The freshly combined additive and beverage can then be dispensed from the beverage container.

BRIEF DESCRIPTION OF THE DRAWINGS

The disclosure may best be understood by reference to the following description taken in conjunction with the accompanying drawings, which illustrate particular embodiments of the present invention.

FIGS. 3A and 3B illustrate one example of a beverage container designed to dispense an additive to a beverage.

FIGS. 4A and 4B illustrate another example of a beverage container designed to dispense an additive to a beverage.

FIGS. 5A, 5B, and 5C illustrate another example of a beverage container designed to dispense an additive to a beverage.

DETAILED DESCRIPTION

Figure 1:
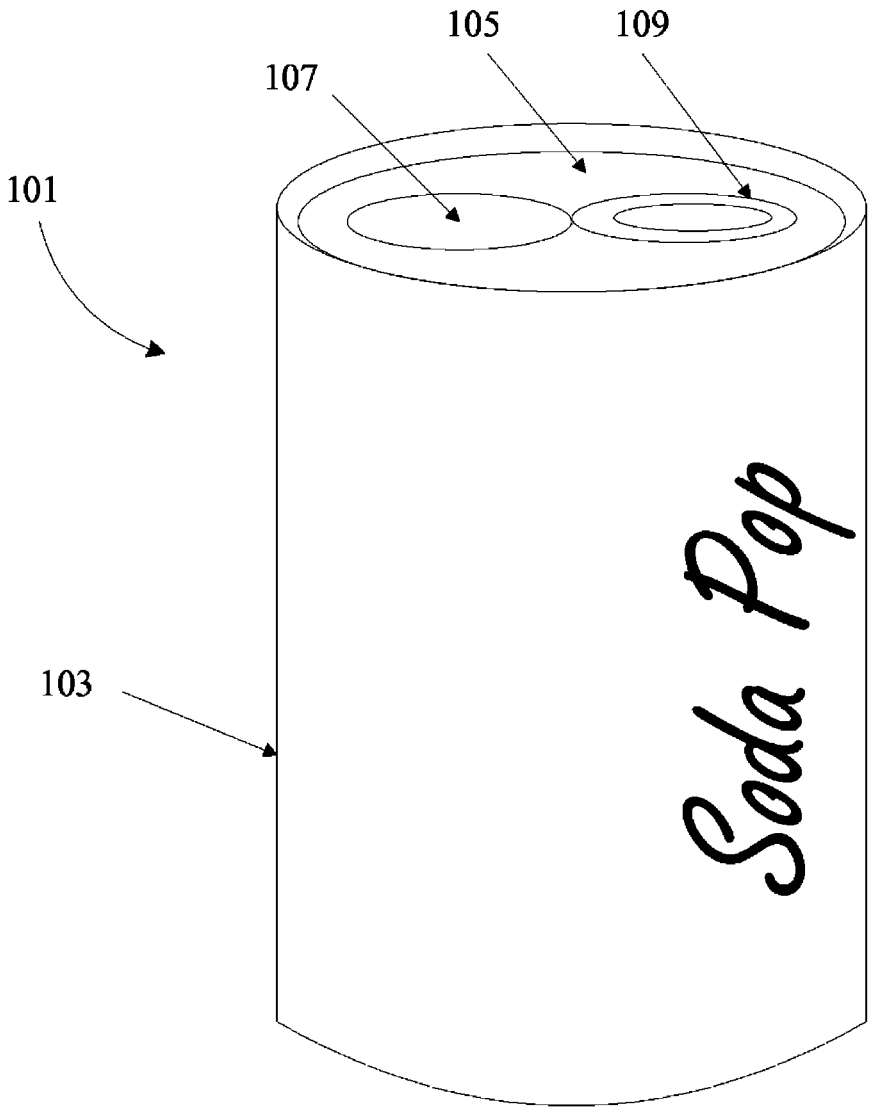
FIG. 1 illustrates a particular example of a beverage container that can use the techniques and mechanisms of the present invention.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Beverages, such as soft drinks, sodas, carbonated drinks, and the like, are commonly provided in containers such as aluminum cans, which are easy to store and serve. These beverages can be consumed directly from a container or poured into a cup or glass. Although these beverages can be consumed without alteration, some people enjoy adding other ingredients to enhance or complement the beverage's flavor. For instance, salt can be added to a cola drink to create a desirable beverage. In another example, a fruit-flavored sweetener or other flavor packet can be added to a drink.

Although it is possible to formulate a new recipe for a beverage with an additional ingredient, such a recipe may not provide the same sensation or experience as adding the ingredient immediately prior to or during consumption of the beverage. For instance, adding salt to a cola may create an immediate froth, texture, crunch, and/or flavor to the drink that would not otherwise occur if the salt were pre-mixed into the drink. In another example, adding a flavor packet to a drink may create a different sensation of texture and varying concentration of the taste from sip to sip. Accordingly, adding an ingredient at the time of consumption may enhance the enjoyment of a beverage.

When a beverage is served in a cup or glass, an additional ingredient can be added to the drink in various ways. For instance, in the case of salt, the salt can be sprinkled into the drink or can be encrusted onto the rim of a glass, as is common with margarita drinks, so that the salt is added as the drink is consumed. However, these manual methods of adding an ingredient to a beverage are inconvenient and time-consuming.

Consequently, the techniques and mechanisms of the present invention provide ways to dispense an additive into a beverage. The additive can be one of many desirable ingredients, such as a flavor packet, salt, coloring, sugar, sweetener, or the like. Additionally, an additive may change the properties of the beverage, such as to create a froth or texture that can enhance the experience of consuming the beverage. The beverage itself can be a flavored drink, a soft drink, a carbonated drink, mineral water, club soda, or the like.

Figure 2:
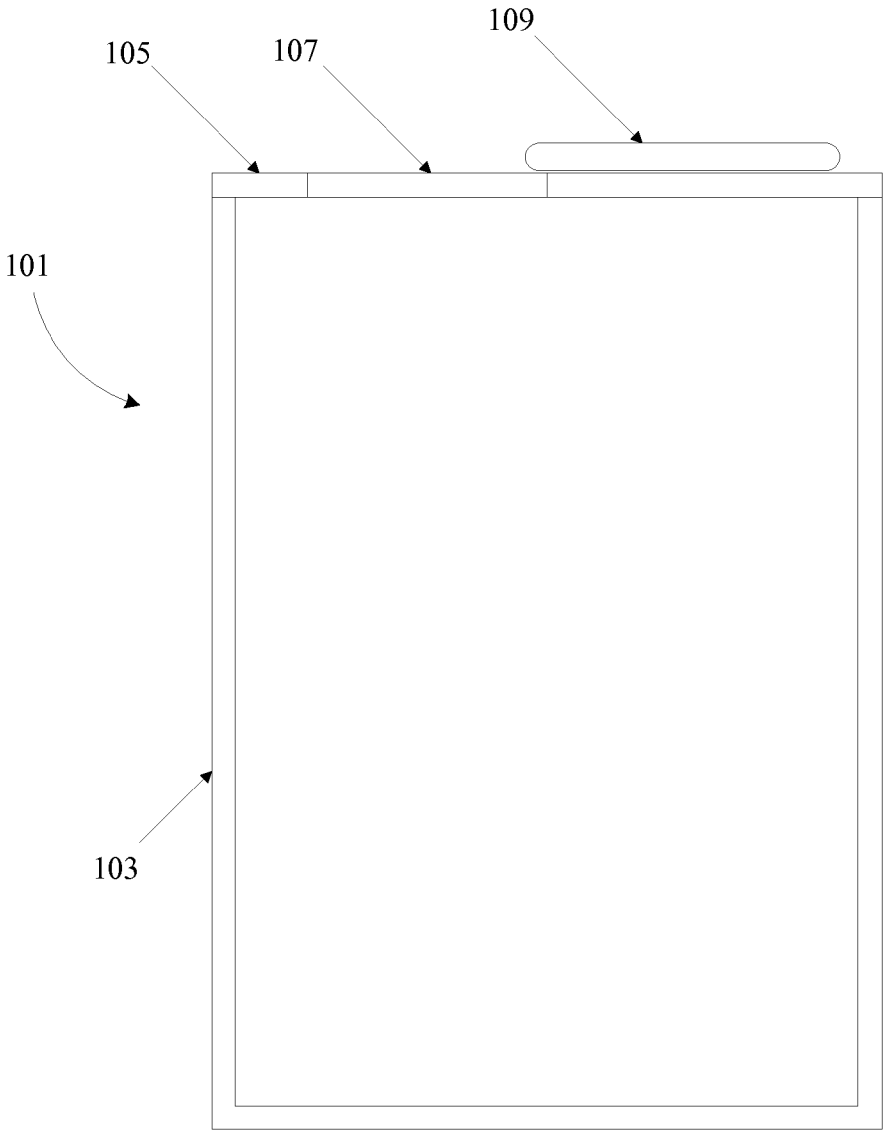
FIG. 2 illustrates another view of a beverage container that can use the techniques and mechanisms of the present invention.

FIGS. 1 and 2 illustrate one example of a beverage container that can use the techniques and mechanisms of the present invention. Beverage container 101 includes a lid 105 and a vessel 103 designed to hold a beverage. The lid 105 includes a flap 107 and a triggering device 109. When the triggering device 109 presses on flap 107, flap 107 folds into vessel 103 and exposes the beverage in vessel 103. Once the flap 107 is folded into the vessel, an opening in the beverage container is left, and the beverage can either be poured from this opening or consumed directly from the container. Flap 107 can be designed to be sealed until it is triggered by triggering device 109, and flap 107 may be outlined by scoring or perforation to allow easy and predictable breakage along the outline and hinging of flap 107. One example of a beverage container is a soda can, which can be made from aluminum, alloys, or other materials.

FIG. 3 illustrates one example of a beverage container designed to dispense an additive into a beverage. FIG. 3A shows a lid 105 of a beverage container before the additive is dispensed and FIG. 3B shows lid 105 of the beverage container as the additive is dispensed.

In FIG. 3A, the beverage container includes lid 105 and vessel 103. Lid 105 includes a flap 107, which can form an opening in lid 105 when triggering device 109 is lifted to press on and fold flap 107 into vessel 103. In the present embodiment, chamber 301 holds an additive 303. As shown, chamber 303 can be attached to lid 105. However, it should be noted that chamber 301 can extend to the wall of vessel 103 in some configurations. It should also be noted that chamber 301 can extend to the end of flap 107 as shown in the figure, or it can extend past the flap to another location on lid 105 or to the wall of vessel 103. Still in another configuration, chamber 301 can extend across only a portion of flap 107. Various configurations in the shape and size of chamber 301 can be used without deviating from the spirit and scope of this invention.

With reference to FIG. 3B, shown is the beverage container of FIG. 3A after triggering device 109 is lifted to press on and fold flap 107 into vessel 103. As shown, flap 107 swings through chamber 301 and breaks the membrane that encloses chamber 301. Once the membrane is broken, additive 303 is free to fall from chamber 301 into vessel 103. Accordingly, additive 303 can then be combined with a beverage in vessel 103 immediately prior to consumption of the beverage. The beverage can be consumed by either pouring the beverage into another container, such as a glass or a cup, or by tipping the container so that the beverage flows directly through the opening created by flap 107 and into the mouth of a consumer.

In the present example, the membrane of chamber 301 can be made from various materials, depending on factors such as the needs of chamber 301, properties of additive 303, the configuration of lid 105 and vessel 103, and the materials used for lid 105 and vessel 103. For example, the membrane can be chosen so that additive 303 can fall smoothly and freely from chamber 301 without sticking to the surface of the membrane. Some examples of materials that can be used to for the membrane include plastic, aluminum, foil, coated paper, etc.

In the present example, FIGS. 3A and 3B show additive 303 as a particulate substance, such as a powder, granulated substance, or the like. Some examples can include salt, sugar, or powdered flavoring. However, the additive 303 can also be a liquid in some examples. For instance, the liquid can be syrup, honey, chocolate, juice, etc. In various embodiments, the liquid can also be a liquor, or the like.

With reference now to FIG. 4, shown is another example of a beverage container designed to dispense an additive into a beverage. FIG. 4A shows a lid 105 of a beverage container before the additive is dispensed and FIG. 4B shows the lid 105 of the beverage container as the additive is dispensed.

In FIG. 4A, the beverage container includes lid 105 and vessel 103. Lid 105 includes a flap 107, which can form an opening in lid 105 when triggering device 109 is lifted to press on and fold flap 107 into vessel 103. In the present embodiment, chamber 401 holds an additive 403. As shown, chamber 401 can be attached to lid 105. However, it should be noted that chamber 401 can extend to the wall of vessel 103 in some configurations. It should also be noted that chamber 401 can extend to the end of flap 107 as shown in the figure, or it can extend past the flap to another location on lid 105 or to the wall of vessel 103. Still in another configuration, chamber 403 can extend across only a portion of flap 107. Various configurations in the shape and size of chamber 401 can be used without deviating from the spirit and scope of this invention.

With reference to FIG. 4B, shown is the beverage container of FIG. 4A after triggering device 109 is lifted to press on and fold flap 107 into vessel 103. As shown, flap 107 swings through chamber 401 and breaks the membrane that encloses chamber 401. Once the membrane is broken, additive 403 is exposed to the contents of vessel 103. As shown in FIG. 4B, Additive 403 is in the form of a solid, which can be attached to at least some portion of lid 105 and/or flap 107. Examples of solids can include salt or minerals in a solid form (such as a salt or mineral lick), rock candy (solid sugar), hard candy, etc. Additive 403 can then be combined with a beverage in vessel 103 immediately prior to consumption of the beverage when additive 403 comes in contact with a beverage in vessel 103. The beverage can come in contact with the beverage either when the beverage is poured into another container, such as a glass or a cup, or when the container is moved and tipped so that the beverage flows directly through the opening created by flap 107 and into the mouth of a consumer.

In the present example, the membrane of chamber 401 can be made from various materials, depending on factors such as the needs of chamber 401, properties of additive 403, the configuration of lid 105 and vessel 103, and the materials used for lid 105 and vessel 103. For example, the membrane can be chosen so that there is a gap between additive 403 and the membrane of chamber 401. Furthermore, the membrane can be chosen so that additive 403 does not stick to the surface of the membrane. By allowing space between additive 403 and the membrane of chamber 401, the surface area of the additive 403 that is exposed to the beverage can be increased, thereby allowing more effective flavoring of the beverage. Some examples of materials that can be used to for the membrane may include a semi-rigid plastic or aluminum, or the like.

Figures 5, 5C:
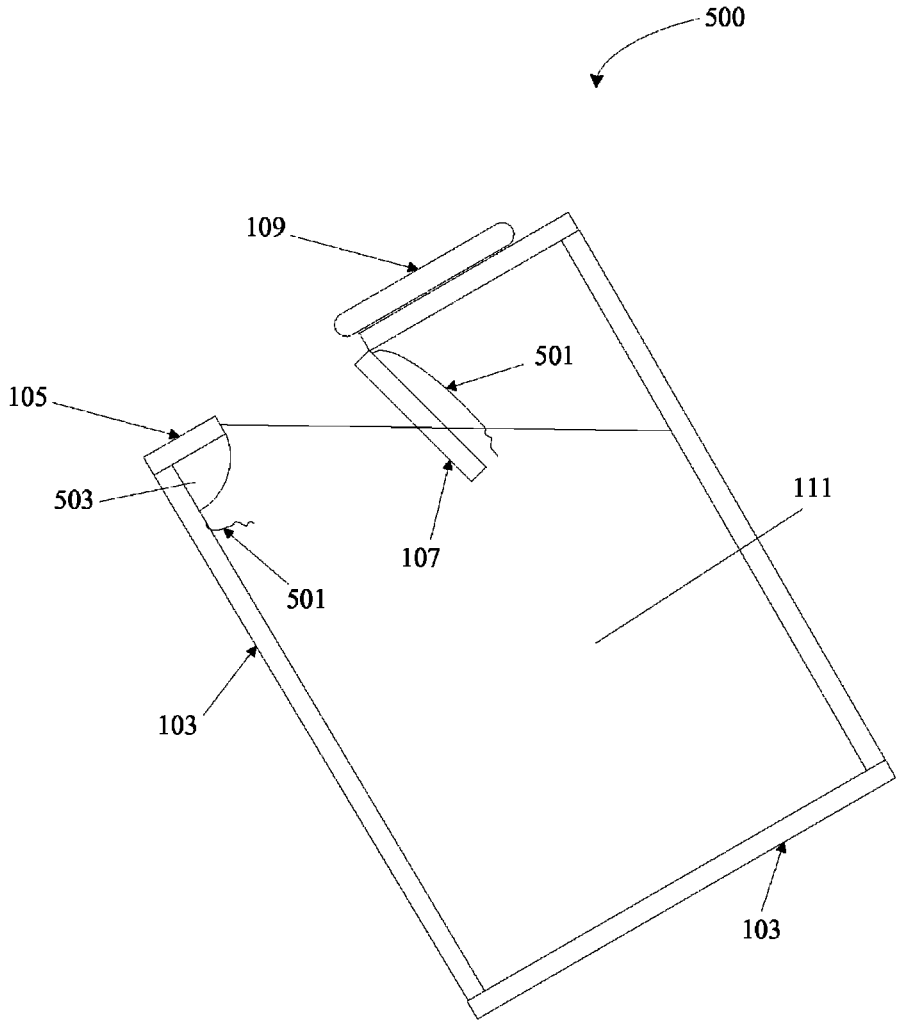

With reference to FIG. 5, shown is yet another example of a beverage container designed to dispense an additive into a beverage. FIG. 5A shows a lid 105 of a beverage container before the additive is dispensed and FIG. 5B shows the lid 105 of the beverage container as the additive is dispensed. FIG. 5C shows a beverage container as a beverage and the additive is dispensed.

In FIG. 5A, the beverage container includes lid 105 and vessel 103. Lid 105 includes a flap 107, which can form an opening in lid 105 when triggering device 109 is lifted to press on and fold flap 107 into vessel 103. In the present embodiment, chamber 501 holds an additive 503. As shown, chamber 501 can be attached to a wall of vessel 103. However, it should be noted that chamber 501 can be attached only to lid 105 in some configurations. It should also be noted that chamber 501 can extend to the end of flap 107 as shown in the figure, or it can extend past the flap to another location on lid 105 or to the wall of vessel 103. Still in another configuration, chamber 501 can extend across only a portion of flap 107. Various configurations in the shape and size of chamber 501 can be used without deviating from the spirit and scope of this invention.

With reference to FIG. 5B, shown is the beverage container of FIG. 5A after triggering device 109 is lifted to press on and fold flap 107 into vessel 103. As shown, flap 107 swings through chamber 501 and breaks the membrane that encloses chamber 501. Once the membrane is broken, additive 503 is exposed to the contents of vessel 103. As shown in FIG. 5B, Additive 503 is in the form of a solid, which can be attached to at least some portion of lid 105 and/or flap 107. Additive 503 can also be attached to the wall of vessel 103 in some embodiments. Examples of solids can include salt or minerals in a solid form (such as a salt or mineral lick), rock candy (solid sugar), hard candy, etc.

In the present example, the membrane of chamber 501 can be made from various materials, depending on factors such as the needs of chamber 501, properties of additive 503, the configuration of lid 105 and vessel 103, and the materials used for lid 105 and vessel 103. For example, the membrane can be chosen so that there is a gap between additive 503 and the membrane of chamber 501. Furthermore, the membrane can be chosen so that additive 503 does not stick to the surface of the membrane. By allowing space between additive 503 and the membrane of chamber 501, the surface area of the additive 503 that is exposed to the beverage can be increased, thereby allowing more effective flavoring of the beverage. Some examples of materials that can be used to for the membrane may include a semi-rigid plastic or aluminum, or the like.

With reference to FIG. 5C, shown is the beverage container 500 after flap 107 is folded into vessel 103 (as shown in FIG. 5B), and the beverage container is then tipped to pour the beverage out of container 500. When beverage container 500 is tilted as shown in FIG. 5C, beverage 111 shifts towards the opening in lid 105 created by flap 107. As beverage 111 shifts, it comes in contact with additive 503 before it is poured out of beverage container 500 and either into another container, such as a glass or cup, or directly into the mouth of a consumer. As shown, the chamber 501 can form a small reservoir where additive 503 can combine with beverage 111 immediately prior to consumption or being served. By placing additive 503 near the edge of the lid 105 as shown, each sip of beverage 111 can include a taste of the additive 503. When the beverage container 500 is then placed upright (i.e. between sips), additive 503 can stay out of contact with the beverage. In this manner, beverage 111 can avoid becoming saturated with additive 503 before consumption. When beverage container 500 is tipped again for another sip, a fresh dose of the additive 503 can be combined with beverage 111. In this way, the taste of additive 503 mixed with beverage 111 can be "fresh" with each sip.

While the invention has been particularly shown and described with reference to specific embodiments thereof, it will be understood by those skilled in the art that changes in the form and details of the disclosed embodiments may be made without departing from the spirit or scope of the invention. It is therefore intended that the invention be interpreted to include all variations and equivalents that fall within the true spirit and scope of the present invention.

What is claimed is:

1. A beverage container comprising:

a vessel configured to hold a liquid beverage;

a lid directly attached to a solid additive selected for the liquid beverage, the lid associated with a flap operable to form an opening allow a beverage consumer to open the vessel and consume the liquid beverage therefrom;

wherein the solid additive remains attached to at least a portion of the lid when the vessel is tilted immediately prior to consumption of the liquid beverage from the vessel, wherein tilting of the vessel causes the solid additive to come into contact with the liquid beverage and the liquid beverage to flow through the opening created by the flap.

2. The beverage container of claim 1, wherein the solid additive is a mineral lick.

3. The beverage container of claim 1, wherein the solid additive is a salt lick.

4. The beverage container of claim 1, wherein the solid additive is a piece of rock candy.

5. The beverage container of claim 1, wherein the solid additive is a piece of hard candy.

6. The beverage container of claim 1, wherein the solid additive is solid sugar.

7. The beverage container of claim 1, wherein the flap is also configured to adhere to the solid additive.

8. The beverage container of claim 1, wherein the solid additive remains attached to at least a portion of the flap when the vessel is tilted immediately prior to consumption of the liquid beverage.

9. The beverage container of claim 1, wherein the liquid beverage is a carbonated liquid beverage.

10. The beverage container of claim 1, wherein the solid additive stays out of contact with the liquid beverage when the vessel is upright even after the flap of the vessel is opened.

11. The beverage container of claim 10, wherein the liquid beverage avoids becoming saturated with solid additive prior to consumption as the solid additive stays out of contact with the liquid beverage.

* * * * *